United States Patent [19]

Angelakos

[11] 4,211,022

[45] Jul. 8, 1980

[54] PICTURE FRAME

[76] Inventor: Nicholas Angelakos, 676 Sinclair Ave., Staten Island, N.Y. 10312

[21] Appl. No.: 947,140

[22] Filed: Sep. 29, 1978

[51] Int. Cl.[3] ..... G09F 1/12

[52] U.S. Cl. ..... 40/152.1; 40/156; 248/489

[58] Field of Search ..... 40/152.1, 152, 156, 40/154, 155, 153, 158 R, 158 B, 124.2, 617; 248/489, 466, 544

[56] References Cited

U.S. PATENT DOCUMENTS

| | | | |
|---|---|---|---|
| 3,694,947 | 10/1972 | Mukai et al. | 40/152 |
| 3,916,549 | 11/1975 | Storch | 40/156 |
| 3,981,091 | 9/1976 | Wiener | 40/152.1 |
| 3,988,846 | 11/1976 | Kuhling | 40/152.1 |
| 4,102,067 | 7/1978 | Tarrant | 40/152.1 |

FOREIGN PATENT DOCUMENTS

| | | | |
|---|---|---|---|
| 2525239 | 2/1977 | Fed. Rep. of Germany | 248/466 |

*Primary Examiner*—John F. Pitrelli

*Attorney, Agent, or Firm*—Alan H. Levine

[57] ABSTRACT

A picture frame including front and rear members each having a main panel and a rearwardly-projecting peripheral wall, at least the front member main panel being transparent. The peripheral walls of the member fit together frictionally to hold the members together with a picture between the main panels. A support element projects rearwardly from the rear member main panel, the support element including a mounting panel and an interconnecting wall joining the mounting panel to the rear member main panel. The mounting panel is spaced from the rear member main panel a distance at least twice as great as the depth of the peripheral wall of the front member, and the area of the mounting panel is no more than 25% of the area of the rear member main panel. Preferably, the main panel and peripheral wall of the front member are formed of one piece of molded plastic, and the main panel and peripheral wall of the rear member and the mounting panel and interconnecting wall of the support element are all formed of one piece of molded plastic.

8 Claims, 4 Drawing Figures

PICTURE FRAME

This invention relates to picture frames particularly intended for mounting photographs. However, it will be obvious that the frame can be used to mount any picture, illustration, or work of art carried on a relatively thin piece of sheet material.

It is an object of the invention to provide a picture frame which appears to "float" in spaced relation to the wall on which the frame is mounted, so that a shadow effect is created around the picture mounted in the frame.

It is another object of the invention to provide such a picture frame consisting of just two parts, each part being formed preferably of molded plastic.

It is a further object of the invention to provide a picture frame including front and rear tray-like members which fit together frictionally with a picture sandwiched between them, the rear member having an integral rearwardly-projecting box-like support element for mounting the frame on a wall, the support member having a depth greater than the depth of the tray like members but having a cross-sectional area much smaller than that of the tray-like members.

It is another object of the invention to provide a picture frame in which a photograph, or other work, can be mounted and maintained against the rear face of a transparent panel without the use of special tools or the need for experience or skill.

Additional objects and features of the invention will be apparent from the following description in which reference is made to the accompanying drawings.

Figure 1:
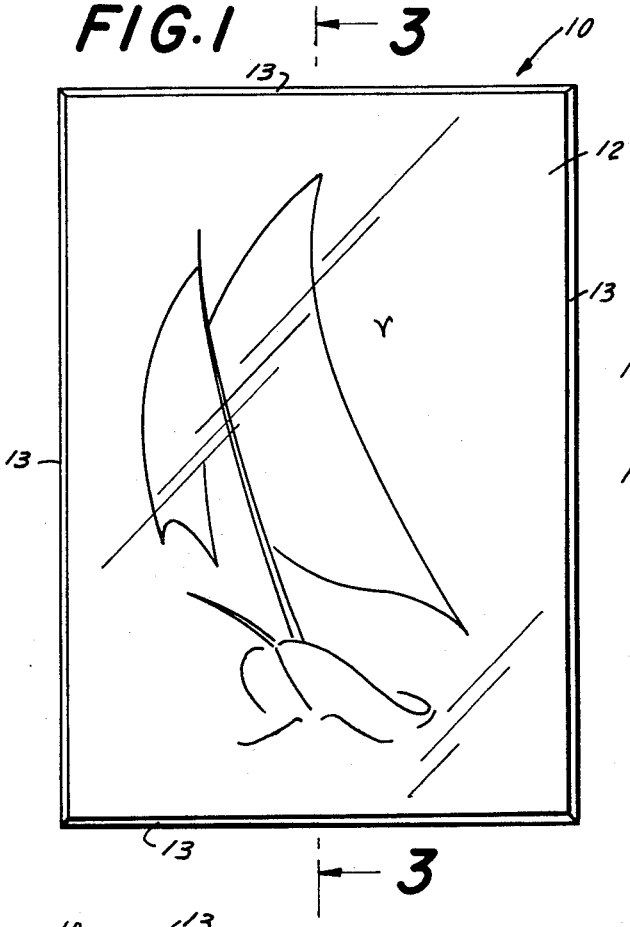
FIG. 1 is a front elevational view of a picture frame according to this invention.
Figure 2:
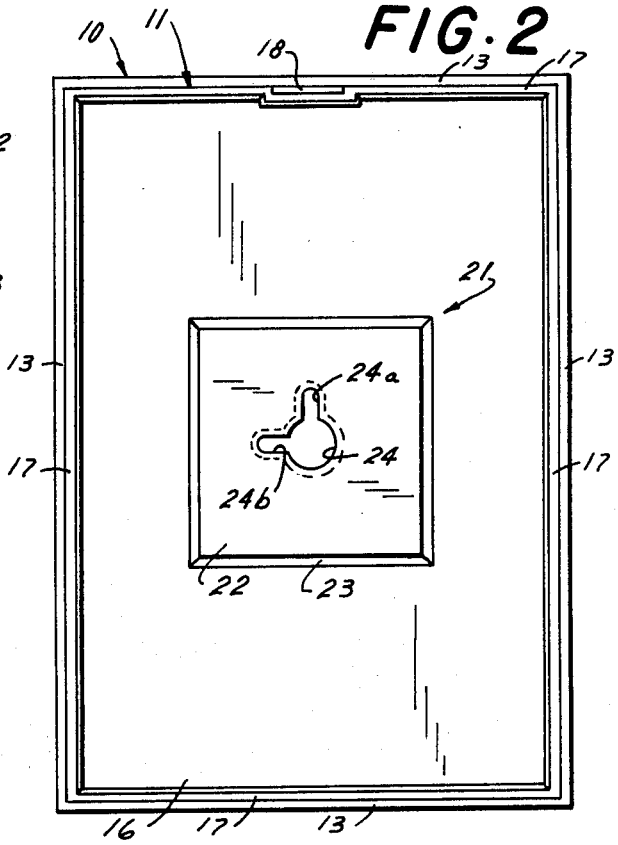
FIG. 2 is a rear elevational view of the picture frame.
Figure 3:
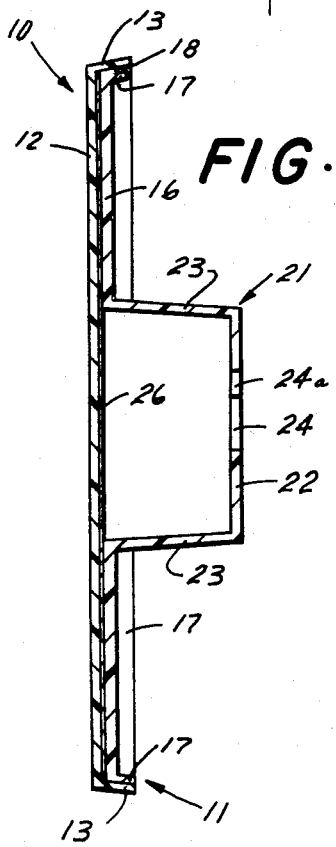
FIG. 3 is a cross-sectional view taken along line 3—3 of FIG. 1.

The picture frame chosen to illustrate the present invention, and shown in FIGS. 1-3, comprises a front tray-like member 10 and a rear tray-like member 11. Front member 10 includes a main panel 12 and a lip 13 projecting rearwardly and outwardly from the periphery of the main panel. Panel 12 is transparent, and in the present example, panel 12 and lip 13 are formed of one piece of transparent molded plastic.

Rear member 11 includes a main panel 16 and a lip 17 projecting rearwardly and outwardly from the periphery of the main panel. The external dimensions of rear member 11 are slightly smaller than the comparable dimensions of front member 10 so that rear member 11 can be nested within front member 10. When the two members are assembled, as shown in FIGS. 2 and 3, the outer surface of lip 17 frictionally engages the inner surface of lip 13 to hold the members 10 and 11 in assembled relationship. The outer surface of lip 17 is formed with a recess 18 for accommodating the edge of a coin or tool, such as a screw driver, to help pry the two frictionally engaged members apart when it is desired to separate them.

Projecting rearwardly from the rear member main panel 16 is a box-like support element 21. The support element includes a mounting panel 22 joined to main panel 16 by an interconnecting wall 23. In the present example, main panel 16, peripheral lip 17, interconnecting wall 23 and mounting panel 22 are all formed of one piece of molded plastic; the plastic is preferably opaque, but could be transparent or translucent if desired. Mounting panel 22 is formed with a substantialy circular hole 24 from which two mutually perpendicular narrow slots **24*a* and 24*b* extend. The picture frame can be mounted on a screw or nail projecting from the wall of a room by slipping hole 24 over the screw or nail head, and then moving the frame downwardly so that slot 24*a* or 24*b* engages over the screw or nail shank. If the shorter sides of the frame are to be horizontal, as shown in FIGS. 1 and 2, slot 24*a* engages the screw or nail shank, whereas if the longer sides of the frame are to be horizontal, slot 24*b*** is used to engage the screw or nail shank.

Support element 21 is deeper than lips 13 and 17 and smaller than main panels 12 and 16. As a result, when the frame is mounted on a room wall, the frame appears to "float" in space at a distance from the wall. This creates a shadow around the frame which is very pleasing esthetically. It has been found that in order to obtain the floating frame and shadow effect, the depth of support element 21 must be at least twice the depth of lip 13, i.e., mounting panel 22 must be spaced from main panel 16 a distance at least twice as great as the depth of lip 13. Furthermore, in order ot obtain the floating frame effect, the cross-sectional area of support element 21, measured in a plane parallel to main panel 16, must be no more than about 25 percent of the area of panel 16. If the area of mounting panel 22, i.e., the cross-sectional area delimited by walls 23, is greater than about 25% of the area of panel 16, support element 21 is seen when the wall-mounted frame is viewed at even a modest angle, thereby destroying the floating frame effect. Additionally, maim panel 16 must have sufficient area to hold a photograph 26 (FIG. 3) flat against the rear face of main panel 12. If box-like support element 21 has a cross-sectional area greater than about 25% of the area of main panel 16, it has been found that the photograph 26 is not given sufficient support from the rear to hold it flat over its entire area.

Figure 4:
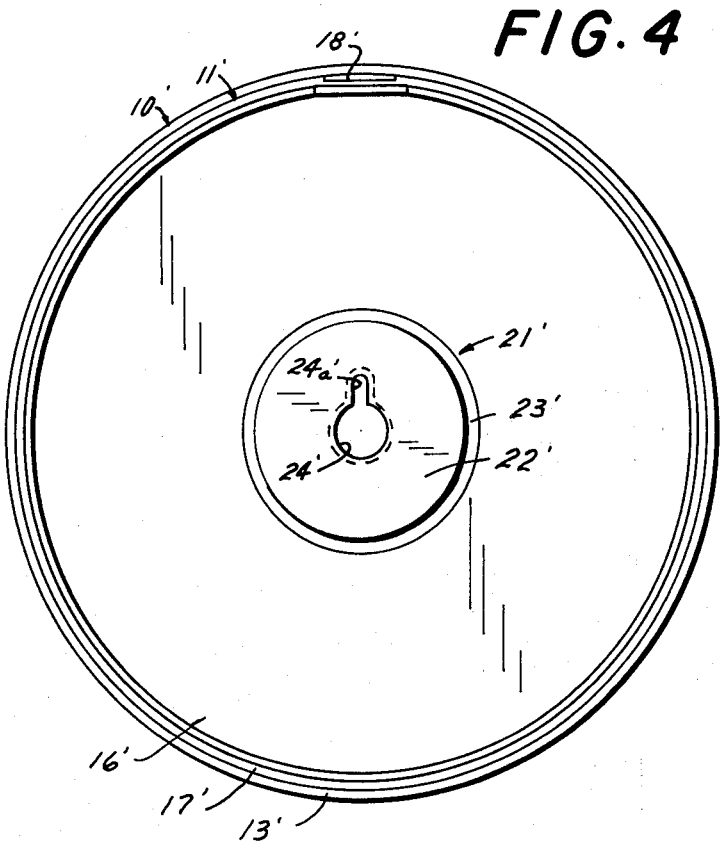
FIG. 4 is a rear elevational view of an alternative embodiment of the picture frame according to this invention.

In FIGS. 1-3 the frame is shown as rectangular. However, it could have any desired shape, such as square or circular, as shown in FIG. 4. In FIG. 4, which is comparable to FIG. 2, the parts corresponding to those of FIGS. 1-3, bear the same reference numerals followed by a prime.

It will be appreciated that the frame of this invention can be made in just two molded plastic parts, namely front member 10, consisting of main panel 12 and peripheral lip 13, and rear member 11, consisting of main panel 16, peripheral lip 17, mounting panel 22, and interconnecting wall 23. In use, the front and rear members are separated, by inserting a thin edge into recess 18 and prying them apart. A photograph 26, or other work to be displayed, is placed against the rear face of transparent main panel 12, and rear member 11 is nested frictionally within front member 10. In this way, the photograph is tightly sandwiched between the main panels 12 and 16. The assembled frame is then mounted on a wall by means of support element 21.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A picture frame comprising (a) a front member including a main transparent panel and a peripheral lip projecting rearwardly from said panel, and (b) a rear member including a main panel and a peripheral lip projecting rearwardly from said rear member panel, said rear member lip being shaped and sized to frictionally engage said front member lip so as to hold the front and rear members together, said members being separable to permit a picture to be placed between said main panels, and (c) a support element projecting rearwardly from said rear member main panel beyond the rear edges of said peripheral lips, said support element having a mounting panel for mounting the picture frame on a wall of a room, said mounting panel being spaced behind said rear member main panel a distance at least twice as great as the depth of the peripheral lip of said front member, and the area of said mounting panel being no greater than about 25% of the area of said rear member main panel.

2. A picture frame as defined in claim 1 wherein said peripheral lips diverge outwardly and rearwardly from their respective main panels.

3. A picture frame as defined in cliam 2 wherein said rear member lip fits frictionally within said front member lip.

4. A picture frame as defined in claim 3 wherein said peripheral lips have surfaces which engage each other when said front and rear members are assembled, and a recess in one of said surfaces for accommodating a tool for prying said members apart.

5. A picture frame as defined in claim 1 wherein said main panel and peripheral lip of each member are formed of one piece of molded plastic.

6. A picture frame as defined in claim 1 including and an interconnecting wall joining said mounting panel to said rear member main panel.

7. A picture frame as defined in claim 6 wherein said means for mounting the picture frame includes a non-circular hole in said mounting panel for accommodating a fastener projecting from the wall of a room.

8. A picture frame as defined in claim 6 wherein the main panel and peripheral lip of said rear member and said mounting panel and interconnecting wall of said support element are all formed of one piece of molded plastic.

* * * * *